United States Patent [19]

Page, Jr.

[11] 3,948,318

[45] Apr. 6, 1976

[54] FLOW CONTROLLING SAFETY VALVE

[76] Inventor: John S. Page, Jr., 10424 Echo River Court, Fountain Valley, Calif. 92708

[22] Filed: Oct. 9, 1974

[21] Appl. No.: 513,470

[52] U.S. Cl. ..... 166/224 A; 251/282; 251/338

[51] Int. Cl.[2] ..... E21B 43/12

[58] Field of Search ..... 166/72, 224 A, 314; 257/282, 324, 325, 336, 338

[56] References Cited

UNITED STATES PATENTS

| | | | |
|---|---|---|---|
| 3,288,221 | 11/1966 | Howard et al. | 166/72 |
| 3,313,350 | 4/1967 | Page, Jr. | 166/72 |
| 3,361,212 | 1/1968 | Page, Jr. | 166/224 A |
| 3,662,824 | 5/1972 | Page, Jr. | 166/72 |

*Primary Examiner*—James A. Leppink
*Attorney, Agent, or Firm*—William W. Haefliger

[57] ABSTRACT

A well safety valve comprises:

a tubing in a well and having a first side port through which well production fluid is flowable, b first means including a valving sleeve movable up and down between predetermined positions on the tubing to control flow of production fluid through said port, said means having surfaces exposed upwardly and downwardly to said flow and characterized in that the upward force exerted by said flow on said means is substantially equal to the downward force exerted by said flow on said means, c said means having a control surface to receive selective application of control fluid pressure for moving the sleeve valve in one direction between said positions.

18 Claims, 9 Drawing Figures

-39-
18
37
11
47
55
10b
52
26
31
35
12
48
-45-
44
30
62
34
24
36
29
38
23
13
49
63
40
41
50
60
61
28
22
59
51
27
33
58
20
56
19
57
21
15
32
17
20a
16
10
10a
64
78a
-85-
79
80
-78-
120
124
121
77
63
60
61
70b
59
73
58
72
56
86
57
71
76
123
122
70a
81
84
83
74
-82-
70
75
108
107
105
101
113
96
112
102
114
117
115
126
92
94
109
95
98
125
116
93
97
91
130
103
90
127
128
129

FLOW CONTROLLING SAFETY VALVE

BACKGROUND OF THE INVENTION

This invention relates generally to controlling the flow of production fluid in a well, and more particularly concerns apparatus and method to achieve surface control of a sub-surface valve, and independently of the pressure of production fluid in the well.

In the past, production flow controlling sleeve valves have been constructed to take advantage of the pressure of the production flow to urge the valve sleeve in one direction between open and closed positions. While this was in certain instances satisfactory, serious problems can arise when the pressure of the production flow varies, as for example can occur with the valve at a fixed installation depth, and also when the valve is moved up or down in the well. For example, if the production flow pressure increases greatly, then it requires much more control pressure to overcome the effect of increased production flow pressure on the valve sleeve, in order to shift the valve sleeve in the opposite direction, or to maintain the valve in open condition, for example. This condition in turn serves to limit the depths at which said sleeve type safety valves can be usefully installed, and also requires monitoring of such valves and adjustment of control pressure application to make sure that they remain in desired open or closed state.

SUMMARY OF THE INVENTION

It is a major object of the invention to provide a surface controlled, sub-surface safety valve characterized in that it is not affected by changes in the pressure of the production flow, and irrespective of the depth at which it is installed. Basically, the invention is embodied in the combination that includes:

a. tubing in a well and having a first side port through which well production fluid is flowable, b. first means including a valving sleeve movable up and down between predetermined positions on the tubing to control flow of production fluid through said port, said means having surfaces exposed upwardly and downwardly to said flow and characterized in that the upward force exerted by said flow on said means is substantially equal to the downward force exerted by said flow on said means, c. said means having a control surface to receive selective application of control fluid pressure for moving the sleeve valve in one direction between said positions.

As will appear, auxiliary means is typically carried to exert predetermined force on the first means tending to shift the sleeve valve in the opposite direction between said open and closed positions. This enables valve response to predetermined control pressure which may be kept low irrespective of well depth. In various forms of the invention, the auxiliary means comprises external and internal weight, external and internal springs, and pre-charged fluid contained in a chamber within the tubing.

Additional objects include the carriage of the auxiliary force exerting means by retrievable structure within the string, such structure for example including a plug to plug the interior of the string, and thereby facilitate construction of the valve assembly in both tubing-to-annulus and tubing-to-tubing forms, as will appear; and the provision of a safety valve of unusually simple and effective construction enabling its installation at any depth and its use uneffected by changes in production fluid pressure.

Finally, it is an object of the invention to provide a method of controlling production fluid flow in a well containing a tubing string as well as valving means movable thereon between open and closed positions, the method including the steps:

a. establishing a barrier across the string interior at a sub-surface location near said valving means, b. flowing production fluid upwardly in the string and then to the exterior thereof below said barrier for continued upward flow in the well and in such manner that the upwardly flowing fluid exerts both upward and downward pressures on said vertically movable valving means, with consequent production of equalized upward and downward forces exerted on said valving means, c. subjecting said valving means to auxiliary force tending to move the valving means in one direction between said positions, and d. exerting control fluid pressure on said valving means tending to move the valving means in the opposite direction between said positions.

These and other objects and advantages of the invention, as well as the details of illustrative embodiments, will be more fully understood from the following detailed description of the drawings, in which:

DRAWING DESCRIPTION

Figure 7A:
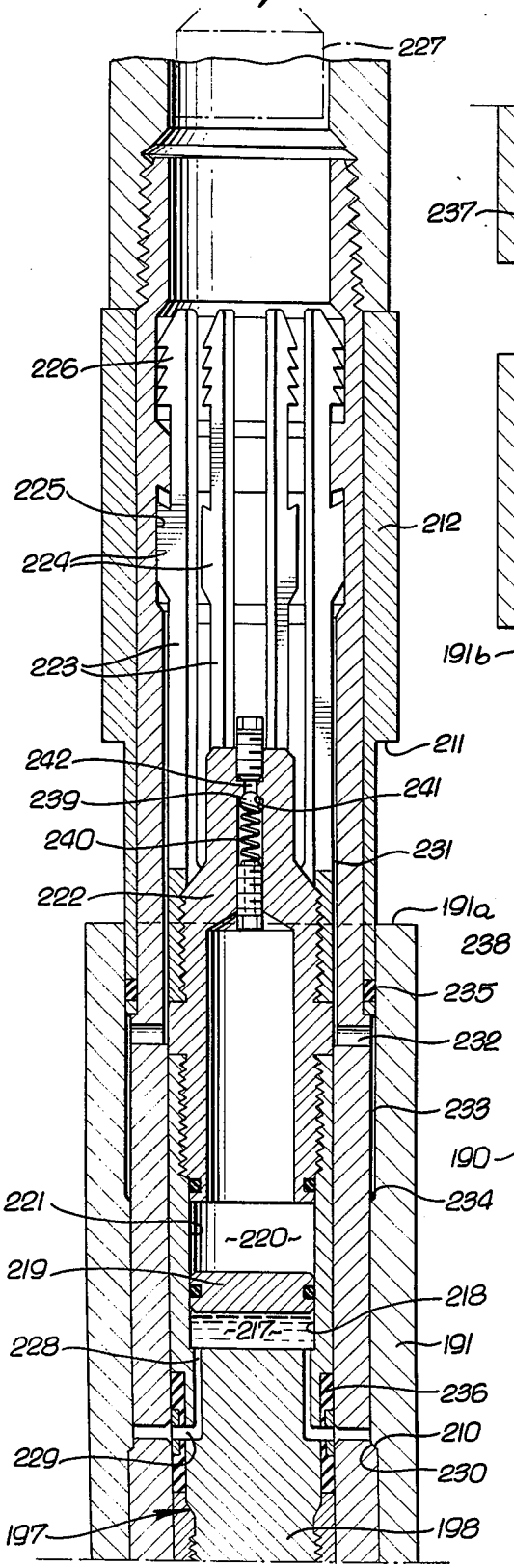
Figure 7B:
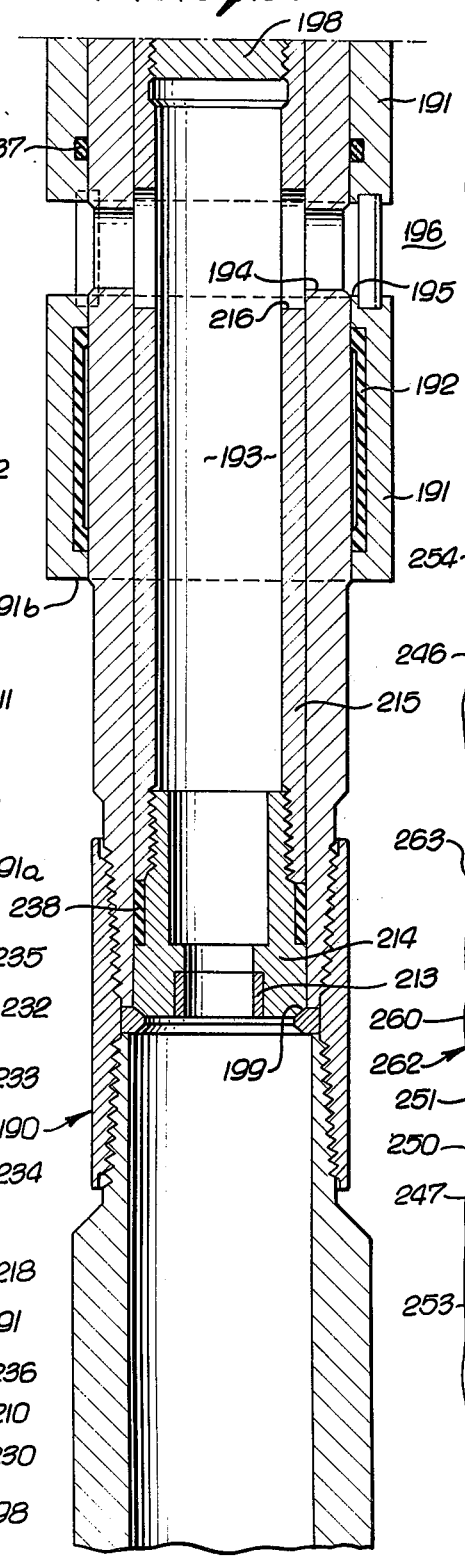
Figure 8:
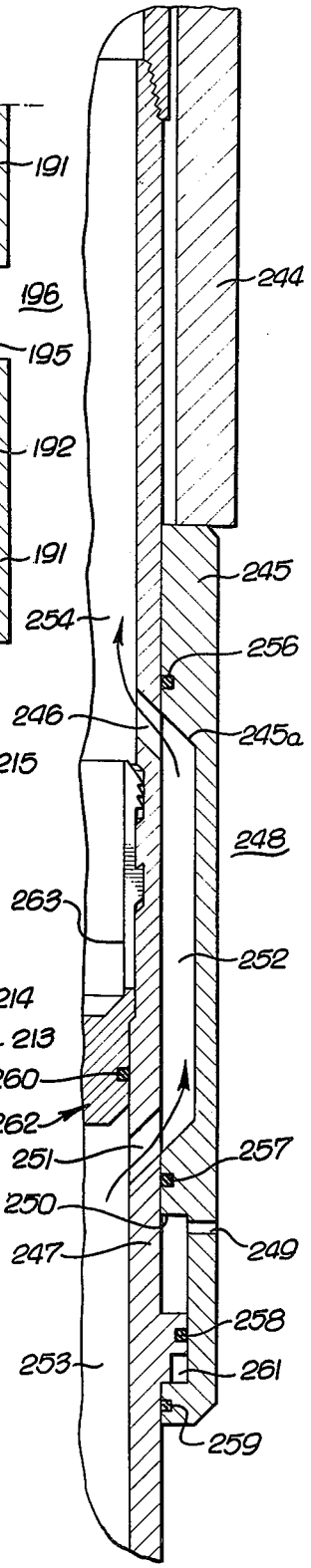

FIGS. 7*a* and 7*b* are vertical sections showing yet another form of the invention; and FIG. 8 is a vertical half-section showing still another form of the invention.

DETAILED DESCRIPTION

Figures 1, 2, 3:
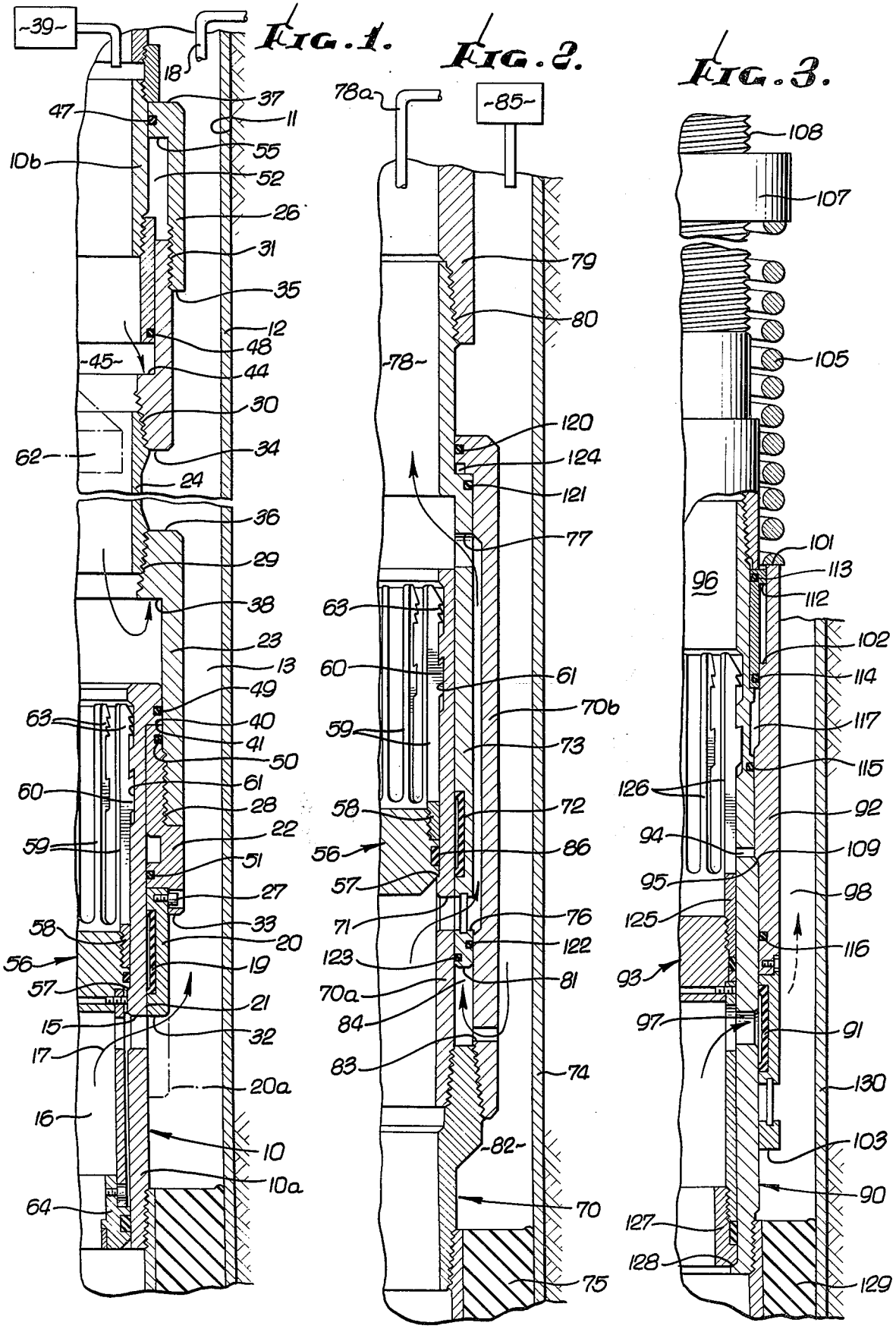
FIG. 1 is a vertical half section showing one form of the invention.
FIGS. 2–6 are vertical half-sections showing additional forms of the invention.

Referring first to FIG. 1, a tubing string 10 is located in a well 11 provided with casing 12. The annulus 13 between the string and casing is packed off at 14 below a side port 15 in the string through which well production fluid is flowable from the string interior at 16 into the annulus above the packer. The flow is represented by arrow 17, and the flow port 15 is in the wall of a valve sub portion 10*a* of the string, as shown. Production fluid flows upwardly in the annulus to the surface for collection in a line indicated at 18.

In accordance with the invention, first means is provided to include a valving sleeve, as for example is shown at 19, movable up and down between predetermined positions on the string to control flow of production fluid through port 15. For example, the tubular carrier 20 for the valve sleeve may be movable between fully up position, as shown in full lines, and down position shown by broken lines 20*a*. The carrier is slidably carried by the exterior surface of the sub 10*a*, at 21, and tubular elements 22–26 are attached to the carrier, and to one another, as by tongue and groove connection 27, and thread connections 28–31.

The first means, as referred to has surfaces exposed or presented upwardly and downwardly to the production flow, and characterized in that the upward force exerted by the flow on the first means is substantially equal to the downward force exerted by the flow on said first means. In the example, downwardly presented surfaces appear at 32–35, and upwardly presented surfaces at 36 and 37. Accordingly, the upwardly and downwardly movable first means is flow pressure balanced, i.e., is not biased upwardly or downwardly by static pressure of the production flow. This condition exists no matter what depth it is installed in a well, so that control pressure, to be described, need not vary with production fluid pressure.

The first means also has a control surface to receive selective application of control fluid pressure, for moving the sleeve valve in one direction between up and down positions. As seen in FIG. 1, the downwardly facing control surface 38 receives application of control fluid pressure supplied within the string, as from control means 39 at the surface, such pressure being sufficient to displace the first means including sleeve valve 19 to up position, as shown. In that position, stop shoulder 40 on element 22 engages stop shoulder 41 on the string.

Auxiliary means is also provided to exert force on the first means tending to shift the sleeve valve in the opposite direction between up and down positions. In the example, such auxiliary means may be considered to include the elongated tubular element 24 of fixed length which exerts weight urging the elements 19, 20, 22 and 23 downwardly, to close the valve about port 15. In this regard, it requires predetermined and fixed pressure of control fluid, exerted upwardly against surface 38 to lift the element 24, and the elements 19, 20, 22, 25 and 26 to open the valve, no matter what the depth of the valve in the well. Such auxiliary means may also be considered to include upwardly exposed surface 44 on telescoping sleeve element 25, to receive pressure of control fluid within the string interior 45. That same fluid pressure is, of course, exerted upwardly against surface 38 previously described. In a specific example, the valve will open at, say 4,000 psi control fluid pressure, and close at 3,500 psi control fluid pressure, irrespective of the depth of the valve in the well. These pressures are representative only, and are used to illustrate the precision of the valve control, without being affected by well production fluid pressure.

Additional structure shown in FIG. 1 includes seals at 47–51, the seal 47 enabling isolation of chamber 52 from both control fluid pressure and production fluid pressure. In this regard, telescoping element 26 has slidable engagement with the surface of upper string section **10*b*; and a tubular part 54 on that section blocks downward travel of the stop shoulder 55 on element 26 to limit downward movement of the sleeve valve. Also, an upwardly retrievable plug 56 is carried or landed by the tubing interior shoulder 57, to block the interior of the tubing above the level of port 15. The plug is carried by a collet 58 having spring fingers 59 releasably attached to the sub 10*a*. For this purpose, the fingers may have latches 60 receivable within annular grooving 61 in the sub, the latching engagement occurring upon downward landing of the plugging means within the string. A pulling tool 62 may be lowered into the string via wire line to engage the external serrations 63 on the upper extension of the spring fingers. In this process, the fingers are cammed inwardly to unlatch the fingers from the grooving 61, and the plug 56 may thereby be upwardly retrieved, whereby the well may be produced through the string, with port 15 closed by the sleeeve valve. This functioning is enabled by the location of the sleeve valve at the string exterior. An annular flow restriction 64** is shown as suspended by the plug.

Turning to FIG. 2, the tubing strong 70 includes inner and outer upwardly projecting tubular extensions **70*a* and 70*b*, the former forming the first side port 71. The first means includes the sleeve valve 72 carried by tubular carrier 73 shown in up, or open position. Well casing appear at 74, and a packer 75 seals off between the string and casing below the level of port 71**.

The first means also forms vertically spaced second and third side ports 76 and 77, the former passing the production flow from port 71 to a vertical flow passage formed between the tubing extension or section **70*b* and the tubular carrier 73. In this regard, port 76 may register with port 71** in up position of the former.

The third port 77 is also formed in the carrier, and is located at a higher elevation than port 76 so as to pass the upward flow into the interior 78 of string 70 and then upwardly to surface line **78*a*. The string 70 is connected with the carrier as at 80, so as to be movable vertically therewith, i.e., the entire weight of the upper tubing 79 (i.e., the auxiliary means) bears down on the carrier tending to close the valve about port 71**.

As before, the vertically exposed surfaces of the first means, including the carrier 73, are characterized in that the valve is substantially pressure balanced as respects the pressure of production fluid. On the other hand, the carrier has a downwardly exposed piston or control surface at 81 to which control pressure in the annulus 82 is applied, via port 883 and chamber 84. Means to vary the control pressure in the annulus and above the packer 75 is shown at 85. Also as before, a retrievable plug is shown at 56 as landed at 57; and elements 58–63 are the same as described in FIG. 1. Also, note seal 86 between the plug and the string bore.

The FIG. 1 valve may be characterized as a tubing to annulus production flow valve, whereas the valve of FIG. 2 is a tubing to tubing production flow valve. Note seals 120–123, and the isolation of chamber 124 from both production fluid pressure and control fluid pressure.

Turning to FIG. 3, the valve assembly there shown is in closed position. The tubing string 90 is continuous, i.e., not terminated at or near the valve, and the sleeve valve 91 and carrier 92 are again at the exterior of the string. Control pressure exerted via the string interior 96 and above plug 93 is controllably applicable via port 94 to piston surface 95 on the carrier 92, to displace the carrier and sleeve valve upwardly, thereby to unblock side port 97 in the string. Accordingly, production fluid may pass from the string interior 96 below the plug to the annulus 98, for collection at the surface. Note seals 115 and 116 at opposite vertical sides of piston surface 95, and seal off between the corner and the tubing. Here again, the upwardly and downwardly exposed surfaces 101–103 of the carrier are characterized in that the carrier is production flow pressure balanced.

The auxiliary means in this embodiment comprises a helical spring 105 endwise confined betweel sleeve valve carrier surface 101 and an adjusting nut 107 threadably mounted on the string at 108 for adjusting spring tension. The spring, which is at the tubing exterior, exerts downward force acting to urge the sleeve valve toward closed condition. In that condition, the piston shoulder 95 seats against shoulder 109 on the string. In fully up-position, with port 97 open, shoulder 102 on the carrier engages limit 112 on the string. Note seals 113-116, and the isolation of chamber 117 from both production fluid pressure and control fluid pressure.

A collet 125 and latching spring arms 126 carry the plug 93. A flow restrictor 127 suspended from the plug lands at shoulder 128 formed by the tubing. A packer 129 seals off between the tubing and the casing 130.

Figure 4:
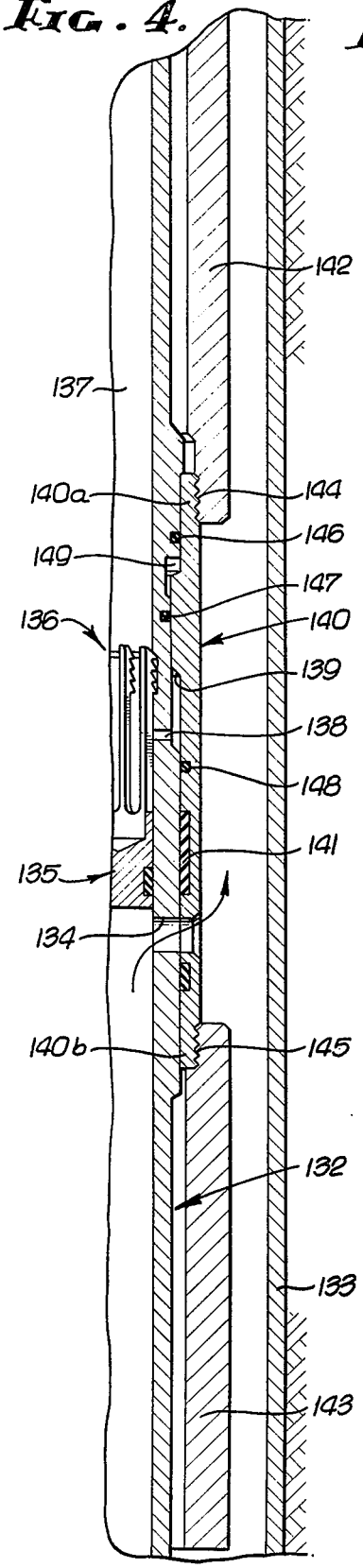

Referring now to FIG. 4, continuous tubing string 132 is received within well casing 133, a packer (not shown) packing off therebetween below the level of side port 134. A retrievable plug 135 is latched at 136 into position within the string, just above the level of side port 134. Control pressure within the string interior 137 above the plug level is applicable via tubing port 138 to the annulus piston surface 139 on a carrier 140 for the sleeve valve 141, to elevate the sleeve valve to open position as shown. In this form, the auxiliary means comprises upper and lower tubular weights such as pipes 142 and 143 attached to the carrier as at 144 and 145, and movable up and down therewith, relative to the string 132. Such weight lowers the carrier and sleeve valve to closed position upon sufficient of control pressure.

As before, the upwardly and downwardly exposed surfaces on first means (which here includes the sleeve valve, carrier and weights) are characterized in that pressure balance is achieved whereby the effect of the production fluid pressure is neutralized insofar as it bears against the upwardly and downwardly movable structure. Note for example that the weights 142 and 143 may have the same inner diameter, and the same external diameter; also, the opposite ends of the carrier at **140*a* and 140*b* have the same inner diameter and the same outer diameter. Note the seals at 146–148, and the isolation of chamber 149** from both control pressure and production fluid pressure.

Figure 5:
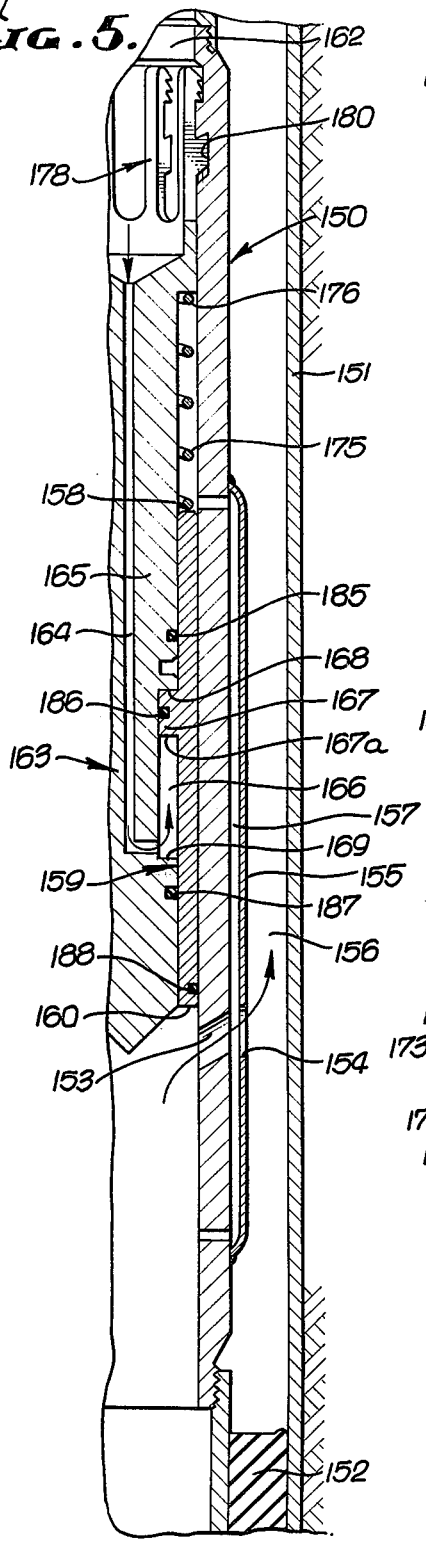
Figure 6:
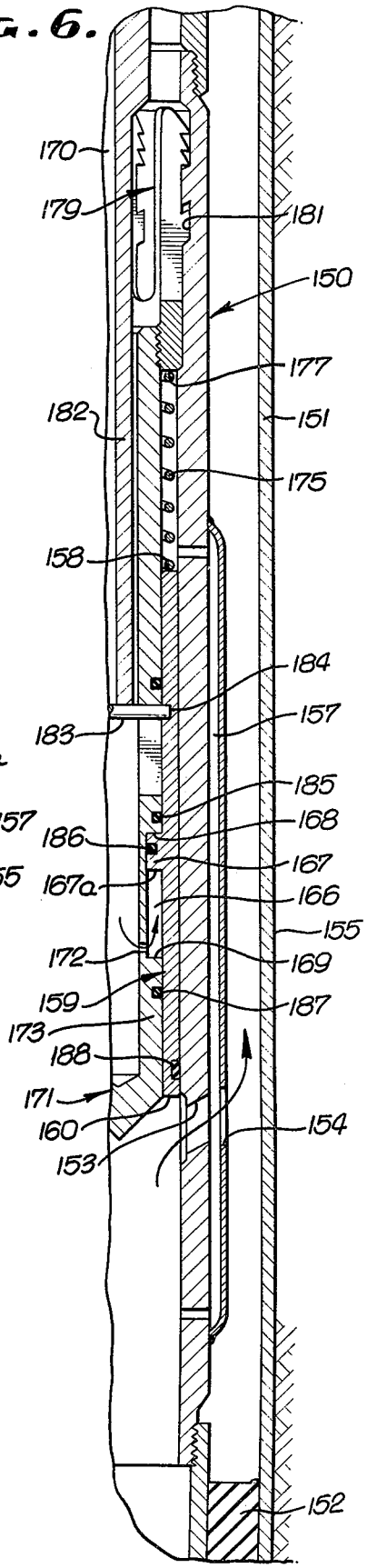

In each of the embodiments of FIGS. 5 and 6 there are similar elements. These include a continuous string 150 received within casing 151, and a packer 152 sealing off between the string and casing. Also, production fluid flows via a side port 153 in the tubing and a side port 154 in an annular housing 155 to the annulus 156, where is flows to the surface for collection. Housing 155 also forms with the tubing a passage 157 to communicate the production fluid pressure to the upper end 158 to the valve sleeve 159 carried at the interior of the tubing. Note that production fluid pressure is also exerted against the lower end 160 of the valve sleeve.

In FIG. 5, control fluid pressure is communicated from the string interior 162 above the inner plug assembly 163 through port 164 in plug 165 to a chamber 166 formed between the plug and valve sleeve, and then to a down facing piston surface **167*a* on the valve sleeve, for urging the sleeve upwardly to valve open position, as shown. Stop shoulders 168 and 169 on the plug assembly limit up-travel and down-travel, respectively, of the sleeve valve piston 167. In FIG. 6, control fluid pressure is communicated from the string interior 170 above the inner plug assembly 171 through a port 172 in plug 173 to chamber 166 as in FIG. 5. Piston 167 and stop elements 168 and 169 are also the same as FIG. 5. Accordingly, in each of FIGS. 5 and 6** the pressure balanced valve sleeve is carried by the retrievable plug assembly, at the interior of the tubing.

Also carried by the plug assembly in each of FIGS. 5 and 6 is a helical spring 175 which exerts downward force on the valve sleeve, and comprises the auxiliary means previously referred to. The upper end of the spring is confined by shoulder 176 in FIG. 5 and 177 in FIG. 6. Note the latching structures 178 and 179 in these figures, for releasably attaching the plug structure to annular grooves 180 and 181 in the tubing interior walls. In FIG. 6, the auxiliary means also includes a rod-type weight 182 confined within the tubing and supported via pin 183 which is in turn attached at 184 to the valve sleeve. Note the seals at 185–188.

Turning to FIGS. **7*a* and 7*b*, the continuous tubing string 190 is understood as intstalled in a well, packed off as at 152 in FIG. 6. The vertically movable first means includes a carrier 191 for sleeve valve 192, the carrier having end surfaces 191*a* and 191*b* which are equal in area so that the carrier is pressure balanced as respects the pressure of production fluid. The latter flows from the tubing interior at 193 via port 194 in the tubing and port 195 in the carrier to the annulus 196 when the carrier is in down (i.e., valve open) position. From the annulus, the production fluid flows to the surface for collection. Tubing shoulder 210 limits the down-stroke of carrier 191, and stop shoulder 211 on a sleeve 212 limits up-travel of the carrier, the sleeve valve then closing port 194**.

A retrievable plug assembly 197 includes plug 198 blocking off the tubing string interior above port 194 when the assembly 197 is landed at shoulder 199. In this regard, a lower extension of the plug assembly forming an annular flow choke 213 lands on shoulder 199, the choke suspended by annular ring 214 and tubular structure 215 connected to the plug 198. Structure 215 forms porting 216 in registration with port or ports 194.

Auxiliary means to exert valve closing force on the carrier 191 comprises a liquid 217 in chamber 218, a piston 219 pressuring that liquid, and compressed gas 220 in precharge chamber 221 pressurizing the piston. Piston 219 works in the chamber bore, and chamber 220 is closed by a cap 222. All of such structure is carried by the retrievable plug assembly, there being latch arms 223 on the assembly and carrying latches 224 removably receivable in grooving 225 in the tubing string. The upper ends 226 of the arms are serrated for camming attachment to a retrieval tool indicated at 227 and lowered by wire line, when desired. The pressure of liquid 217 is communicated via ports 228 and 229 to downward facing piston surface 230 on the carrier, so that in the absence of sufficient control pressure urging the carrier downwardly, the latter is urged upwardly by the pressure of liquid 217, to close the valve. Control pressure is applicable downwardly within the tubing, as previously described, and communicated via clearance at 231 between the cap 222 and the tubing bore to port 232, and thence via clearance at 233 to upward facing annular piston face 234 on the carrier. Sufficient control pressure application enables downward displacement of the carrier to valve open position. Seals are shown at 235–238.

Pre-charge pressure in chamber 220 may be adjusted via a pre-charge ball valve 239 spring urged upwardly at 240 to engage annular tapered seat 241 on cap 222. The pressure entrance duct to the valve is indicated at 242.

In FIG. 8, the structure is similar to FIG. 4 in that a predetermined weight 244 is employed to urge the carrier 245 for sleeve valve **245*a* downwardly toward closed position, i.e., across port 246 in tubing string 247. The valve 245*a* is integral with the carrier. Control pressure is exerted via the annulus 248 and port 249 in the carrier to the downward facing piston surface 250 on the carrier, tending to raise it to valve open position as shown. Here again, the carrier is pressure balanced as respects production flow which courses from tubing lower interior 253 through a lower port 251 in the tubing into a flow passage 252 formed between the carrier and the tubing, and then through the upper port 246 into the tubing upper interior 254. Accordingly, a tubing-to-tubing form of the flow pressure balanced valve is provided. Note seals 256–260, and the chamber 261 isolated from both production flow pressure and control fluid pressure. A retrievable plug assemly is shown at 262, with latching fingers 263.**

I claim:

1. In combination, a tubing in a well and having a first side port through which well production fluid is flowable, b first means including a valving sleeve movable up and down between predetermined positions on the tubing to control flow of production fluid through said port, said means having different surfaces facing upwardly and downwardly for exposure to said flow and characterized in that the upward force exerted by said flow on said means is substantially equal to the downward force exerted by said flow on said means, c said means having a control surface to receive selective application of control fluid pressure for moving the sleeve valve in one direction between said positions, d and auxiliary means including fixed tubular weight carried above the valve to exert predetermined force on said first means tending to shift the sleeve valve in the opposite direction between said positions.

2. The combination of claim 1 wherein an upwardly exposed surface receives upward pressure of control fluid within a zone defined within the tubing for lifting said weight.

3. The combination of claim 2 wherein the tubing includes upper and lower sections which are interconnected via said fixed tubular weight.

4. The combination of claim 1 including an upwardly retrievable plug carried by the tubing to block the interior of the tubing above the general level of said port.

5. The combination of claim 1 including well casing receiving said tubing, and a packer sealing off between the tubing and casing below the level of said port.

6. The combination of claim 1 wherein said sleeve valve is located at the exterior of the tubing.

7. The combination of claim 1 wherein said weight is operatively connected to said sleeve valve to urge the sleeve valve in a port closing direction.

8. The combination of claim 7 wherein said first means includes a sleeve valve carrier forming with the tubing a flow passage to pass production fluid from a tubing lower interior zone to a tubing upper interior zone via said port and an additional side port in the tubing.

9. In combination, a tubing in a well and having a first side port through which well production fluid is flowable, b first means including a valving sleeve movable up and down between predetermined positions on the tubing to control flow of production fluid through said port, said means having different surfaces facing upwardly and downwardly for exposure to said flow and characterized in that the upward force exerted by said flow on said means is substantially equal to the downward force exerted by said flow on said means, c said first means having a control surface to receive selective application of control fluid pressure for moving the sleeve valve in one direction between said positions, and d auxiliary means carried to exert predetermined force on said first means tending to shift the sleeve valve in the opposite direction between said positions, e said first means forming vertically spaced second and third side ports, and said tubing including a tubing section extending about the sleeve valve and forming therewith a flow passage to receive upward flow of production fluid that has passed through said first and second side ports when in registration, said third side port located to pass said upward flow into the tubing above the level of said first and second side ports.

10. The combination of claim 9 including an upwardly retrievable plug carried by the tubing to block the interior of the tubing between said second and third side ports.

11. In combination, a tubing in a well and having a first side port through which well production fluid is flowable, b first means including a valving sleeve movable up and down between predetermined positions on the tubing to control flow of poduction fluid through said port, said means having different surfaces facing upwardly and downwardly for exposure to said flow and characterized in that the upward force exerted by said flow on said means is substantially equal to the downward force exerted by said flow on said means, c said means having a control surface to receive selective application of control fluid pressure for moving the sleeve valve in one direction between said positions, and d auxiliary means carried to exert predetermined force on said first means tending to shift the sleeve valve in the opposite direction between said positions, said auxiliary means comprising a spring carried by the tubing to exert force acting to urge the sleeve valve in a port closing direction.

12. The combination of claim 11 wherein said spring is a helical spring extending about the tubing at the exterior thereof.

13. The combination of claim 11 including retrievable plug structure carried by the tubing and located therein to block said interior above the general level of said port, said spring and sleeve valve carried by said retrievable structure.

14. The combination of claim 13 including an annular housing about said tubing and forming therewith a passage to communicate production fluid pressure too the upper end of said sleeve valve.

15. The combination of claim 13 including an elongated weight carried to transmit downward force to said sleeve valve.

16. In combination, a tubing in a well and having a first side port through which well production fluid is flowable, b first means including a valving sleeve movable up and down between predetermined positions on the tubing to control flow of production fluid through said port, said means having different surfaces facing upwardly and downwardly for exposure to said flow and characterized in that the upward force exerted by said flow on said means is substantially equal to the downward force exerted by said flow on said means, c said means having a control surface to receive selective application of control fluid pressure for moving the sleeve valve in one direction between said positions, and d auxiliary means carried to exert predetermined force on said first means tending to shift the sleeve valve in the opposite direction between said positions, said auxiliary means comprising fluid pressure carried within a pre-charge chamber, there being retrievable plug structure carrying said chamber, the tubing having a port to pass said pre-charge fluid pressure to a piston surface on said first means.

17. In combination a tubing in a well and having a first side port through which well production fluid is flowable, b first means including a valve element movable between predetermined positions on the tubing to control flow of production fluid through said port, said means having surfaces exposed upwardly and downwardly to said flow and characterized in that the upward force exerted by said flow on said means is substantially equal to the downward force exerted by said flow on said means, c said means having a control surface to receive selective application of control fluid pressure for moving the valve element in one direction between said positions, d and auxiliary means including fixed tubular weight carried outside said tubing to exert predetermined force on said first means tending to shift the valve element in the opposite direction between said positions.

18. The combination of claim 17 wherein said tubular weight is also located above the level of the valve element.

* * * * *